United States Patent [19]

John

[11] 4,273,647

[45] Jun. 16, 1981

[54] APPARATUS FOR AND A METHOD OF SEPARATING GRINDING BODIES AND GROUND MATERIAL IN AN AGITATOR MILL

[75] Inventor: Willy John, Selb, Fed. Rep. of Germany

[73] Assignee: Gebruder Neizsch Maschinenfabrik GmbH & Co., Fed. Rep. of Germany

[21] Appl. No.: 68,799

[22] Filed: Aug. 22, 1979

[30] Foreign Application Priority Data

Aug. 24, 1979 [DE] Fed. Rep. of Germany ..... 2836969

[51] Int. Cl.[3] ..... B07B 7/06

[52] U.S. Cl. ..... 209/250; 209/379; 209/396; 209/625; 241/69; 241/171

[58] Field of Search ..... 209/144, 250, 396, 379, 209/310, 625, 365 R; 241/69, 171, 172, 175

[56] References Cited

U.S. PATENT DOCUMENTS 3,311,310 3/1967 Engels et al. ..... 241/171 X
3,904,133 9/1975 Bicik et al. ..... 241/69

FOREIGN PATENT DOCUMENTS 360629 11/1931 United Kingdom ..... 209/250

*Primary Examiner*—Ralph J. Hill
*Attorney, Agent, or Firm*—Karl W. Flocks

[57] ABSTRACT

A separator system for separating grinding bodies and ground material in an agitator mill wherein stationary and moveable or oscillating separator members in a grinding chamber define a variable gap which narrows when a moveable separator member moves against the flow of ground material.

20 Claims, 16 Drawing Figures

1

APPARATUS FOR AND A METHOD OF SEPARATING GRINDING BODIES AND GROUND MATERIAL IN AN AGITATOR MILL

The invention relates to an apparatus for and a method of separating grinding bodies and ground material in an agitator mill, comprising separator members which border on the grinding chamber and define at least one gap between them of a nominal width smaller than the nominal size of the grinding bodies in the grinding chamber, at least one separator member being arranged to be stationary and at least one separator member being designed to be movable and connected with a drive means adapted to impart oscillating motions to the movable separator member in the direction of flow and contrary to the direction of flow of the ground material passing through the gap.

Such a separator for use in an agitator mill is known from DE-OS No. 24 46 341* It comprises a vibrator by means of which at least one separator member can be caused to vibrate. The separator members are embodied by separator rings. The known separating apparatus has found wide approval in practice. In continuous operation, however, sometimes difficulties are encountered when using this separator in particular with grinding bodies of very small nominal dimension. The nominal dimension or size of grinding bodies is their diameter and in the case of unround grinding bodies it is understood to be the smallest diameter.

*which corresponds to U.S. Pat. No. 3,904,133 to Bicik et al.

In the known separator the gaps are designed to have parallel planes and it is attempted to maintain their nominal width in operation unchanged to the best possible degree. Yet with one embodiment of the known structure (DE-OS No. 24 46 341, FIG. 4) the gaps which have their nominal width at a starting position of the separator members are narrowed and enlarged beyond their nominal width periodically by moving the separator members toward each other and away from each other transversely of the flow of ground material. This may cause problems in that grinding bodies whose nominal size corresponds approximately to the nominal width of the gaps can enter into the gaps between the separator members where they are destroyed by grinding.

It is the object of the invention to avoid these drawbacks and provide a separator for agitator mills suitable also for very small grinding bodies, e.g. with a nominal size of 0.2 to 0.5 mm, without causing any disturbances in operation.

This object is met, in accordance with the invention, in that at least one of the separator members is so tapered at its side facing the gap that the gap narrows from its nominal width to a minimum value whenever the movable separator member moves against the flow of the ground material.

The invention is based on the following finding: Grinding bodies whose nominal size is much larger than the nominal width of the gap or gaps of the separator are retained by the separator without any difficulty, in other words they remain in the grinding chamber. Grinding bodies whose nominal size is much smaller than the nominal width of the gap slip through the gap together with the passing ground material and, consequently, are no problem for the operation proper of the agitator mill. Yet, of course, they are afterwards contained in the ground material.

Difficulties are encountered, on the other hand, with grinding bodies which, for reasons of faulty classification or wear, have a nominal size which is only slightly greater than the nominal width of the gap or corresponds to the nominal width of the gap. Such grinding bodies have a tendency to stick in the gaps of separators and even accumulate there in greater numbers. Part of such grinding bodies can be reduced to an uncritical size or disintegrated completely, yet part may remain in the gap and cause further grinding bodies to become stopped until real stagnation of the flow occurs or mechanical damage is done to the separator.

These difficulties are eliminated by the invention since the gap width is never increased beyond the nominal width but instead is temporarily narrowed and because adjacent grinding bodies are pushed back into the grinding chamber by the movable separator member.

This means that in particular grinding bodies of critical size which tend to collect in a gap having approximately the same size are positively acted on by the movable separator member at the beginning of the gap and are pushed away from the separator into the free grinding chamber. There they are immediately entrained by the intensive flow of the ground material caused by known agitator means and thus also carried away laterally from the separator so that the gap or gaps of the separator is or are always kept free.

It is possible to have the movable separator member carry out only individual impacts from time to time. Preferably, however, the movable separator member is movable periodically at a frequency between 1 and 40, preferably between about 20 to 30 cycles per second.

At such frequencies the time available for any grinding bodies of critical size entrained by the exiting ground material to pass through the gap between the separator members is in the order of, for example, 1/20 000 second to 1 second and, therefore, so short that passage of these grinding bodies which should be kept back is impossible.

On the other hand, if it is more important to obtain a sufficient cross section in time (product of opening time multiplied by opening cross section) for the passage of the ground material at predetermined gap cross sections by keeping the gap or gaps open approximately at their nominal width, it is advantageous for the movable separator member in reciprocating to stay for a longer period of time each approximately in the position at which the effective gap width corresponds to the nominal width than in that position at which the effective gap width is reduced to a minimum value.

This requirement can be fulfilled readily by corresponding kinematics in the drive means serving to move the movable separator member, in a manner similar, for example, to the valve control of internal combustion engines and the like.

On the other hand, it may be advantageous if the effective gap width during movement of the movable separator member out of its starting position can be reduced temporarily from the nominal width to a minimum value of zero.

The invention may be so embodied that the surfaces of two separator members defining a gap are so inclined with respect to each other that the gap has its nominal width at its beginning facing the grinding chamber when the movable separator member is in its starting position and widens regularly or irregularly from that position in the direction toward its end which is remote from the grinding chamber.

This widening of the gap cross section in the direction of flow which may be termed "free angle" has a favorable effect in preventing any grinding bodies which have entered the gap from becoming stuck. Furthermore, this measure provides a noticeable reduction of the flow resistance of the separator against the passage of the ground material.

The surface of the one separator member defining a gap may be designed to extend parallel to the direction of movement of the movable separator member, while the surface of the other separator member defining the gap is inclined to the direction of movement. It is also possible for both surfaces of two separator members defining a gap to be inclined in the same direction yet at different angles with respect to the direction of movement of the movable separator member.

In both cases it becomes possible to vary the nominal width of the gap by a unique change of the relative positions of the fixed and movable separator members. Preferably, this may be effected by having the effective length of intermediate elements between a drive means serving to move the movable separator member, such as a vibrator or the like, and the movable separator member designed to be variable whereby the nominal width of the gap is adjustable. This is important for adjustment of the apparatus so as to adapt it to other operating conditions, to carry out tests, and to compensate for wear.

It is further provided that the surfaces of the separator member facing the grinding chamber when the movable separator member is in its starting position are at least approximately aligned and that the movable separator member, when being moved toward the grinding chamber protrudes beyond immediately adjacent surfaces. This flush arrangement of the separator with its surroundings facilitates the reception of grinding bodies rejected by the movable separator member in the main stream of the ground material. Moreover, if the gap width should be reduced down to zero, this provides a favorable angle at which the movable separator member and the stationary separator member meet, so that consequently wear is reduced.

Preferably, the invention is realized in that several gaps are formed each between one surface each of two stationary separator members and two surfaces of a movable separator member. In that case a movable separator member will be positioned between the surfaces of two stationary separator members defining the gap so that approximately twice the cross sectional area for passage of the ground material is obtained with only one movable member and otherwise only little greater structural expenditure.

The gaps may be straight paths, yet it is preferred that the gap or gaps is or are annular, preferably circular since this provides in the easiest way for simple finishing to observe close tolerances.

A convenient embodiment of the invention for a single gap is characterized in that the movable separator member is a conical lifting ring whose conical circumferential surface has its smallest diameter at its beginning which faces the grinding chamber, and that the stationary separator member is an outer ring whose inner annular surface is inclined in the same direction but more strongly conically than the conical circumferential surface of the lifting ring, whereby the gap between the lifting ring and the outer ring widens gradually from its beginning which faces the grinding chamber.

The preferred embodiment, however, is one with two annular gaps, wherein the movable separator member is a lifting ring having outer as well as inner conical ring surfaces at its side facing the grinding chamber and forming two annular gaps together with a stationary outer ring and a stationary inner ring disposed adjacent to it at the inside. These gaps widen gradually from their beginning which faces the grinding chamber. Thus simple means afford a greater cross sectional area for passage of the ground material resulting in a lower flow resistance.

Further advantageous features of these structures may be gathered from the claims and from the description of the embodiments.

In a particularly preferred embodiment of the invention an eccentric drive means comprises a connecting rod rotatably supported on an eccentric shaft and connected by an adjustment cam with a driven intermediate piece linked with the guide element of the lifting ring in such manner that the depth of immersion of the lifting ring into the space between the inner ring and the outer ring is adjustable. In addition to its fine grading this possibility of adjustment and variation has the advantage of being readily accessible from outside at any time.

A method of operating the apparatus described may be characterized in that the movement of movable separator members is switched on, preferably automatically, when the pressure in the grinding chamber surpasses an adjustable normal level. A pressure rise in the grinding chamber of an agitator mill usually is a sign of increased flow resistance of the separator at the outlet for the ground material. By moving the movable separator member the separating apparatus then can quickly be made free again. The movement may be switched off after an adjustable period of time or likewise in response to the pressure, either by hand or in any other suitable manner. It is also possible to switch on the movement for a short time, for instance, every 5 seconds or every 5 minutes.

Embodiments of the invention will be described below, with reference to diagrammatic drawings, in which.

Figure 3:
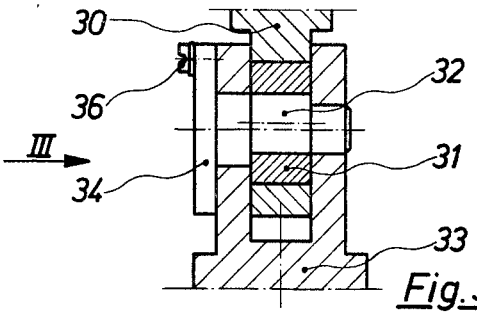
FIG. 3 is a detail of FIGS. 1 and 2.
Figure 3A:
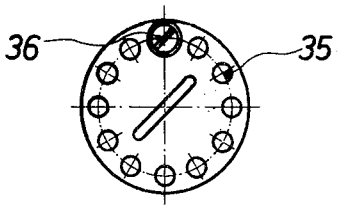
Figure 9:
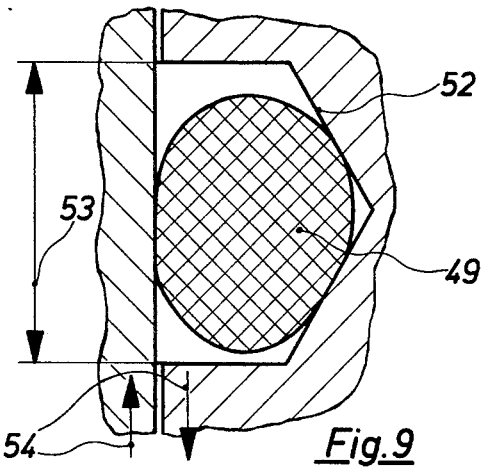
Figure 9A:
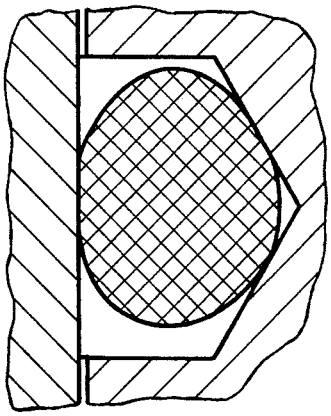

FIG. 3*a* is a side elevation in the direction of arrow III of FIG. 3;

FIGS. 4 to 8*a* are details of various embodiments, each in two positions and on an enlarged scale;

FIGS. 9 and 9*a* are details of a sealing means in two positions.

Figure 1:
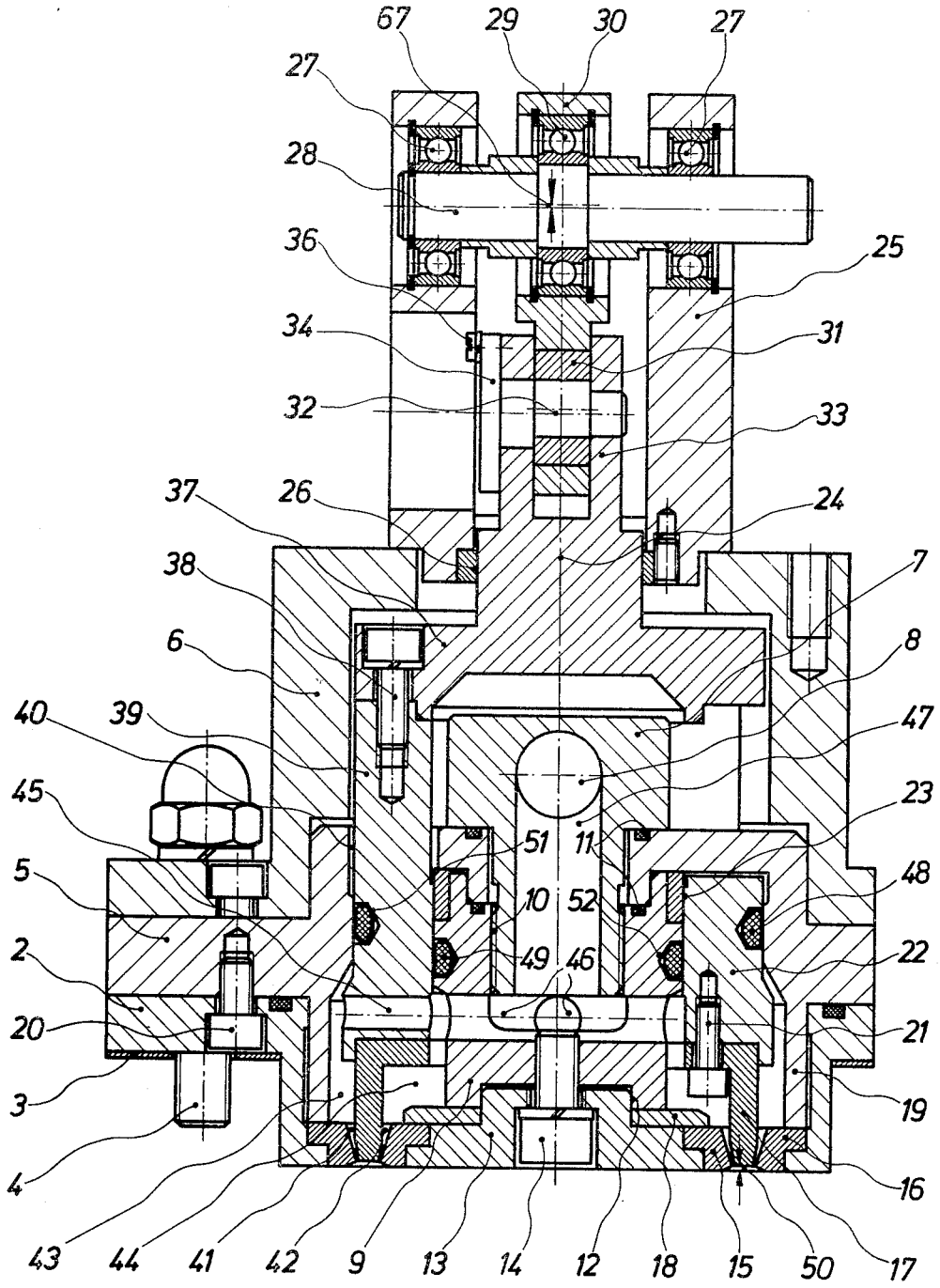
FIG. 1 is an axial section of a first embodiment of a separator.

The lower face as seen in FIG. 1 of the separator shown borders on the grinding chamber 1 of an agitator mill (not shown) of conventional structure. In operative condition this grinding chamber contains an agitator and free grinding bodies as well as the material to be ground. The material is fine-ground or pulverized and dispersed or emulsified, and the separator serves to separate the treated material from the grinding bodies such that the treated pulverized material can be discharged while the grinding bodies are retained in the grinding chamber 1.

The separator is inserted at a suitable place in a cover or shell of the agitator mill with the aid of a separator flange 2 and a seal 3 positioned in between and is fixed by means of screws 4. The separator in general is essentially rotationally symmetrical, while the separator flange 2, however, may have, for instance, a square outline. The separator flange 2 carries a central flange 5 and the central flange carries a covering flange 6, all flanges 2, 5, and 6 being centered with respect to one another and secured together by screws. The central flange 5 carries a central holding piece 7 furnished with a lateral discharge pipe 8 for the ground material.

A fixed guide body 9 provides with a thread 10 is screw-connected with the central holding piece 7 in such manner that both parts are firmly anchored on the central flange 5 with the intermission of seals 11. The threaded connection preferably is releasable from the grinding chamber 1 side.

A centering projection 12 formed at a carrier disc 13 is inserted into the guide body 9 at the side facing the grinding chamber and is fixed therein by a central screw 14. At its periphery the carrier disc 13 carries a closely fitting inner ring 15 which is retained by a clamping disc 18. The clamping disc 18 itself is clamped between the guide body 9 and the carrier disc 13 by the central screw 14. Thus no connection between the inner ring 15 and the carrier disc 13 by direct screwing, cementing, soldering or the like is required.

In similar manner an outer ring 16 is fit in the separator flange 2 and firmly pressed by a projection 19 formed at the central flange 5 against a seat formed at the separator flange 2. Thus the inner ring 15 and the outer ring 16 both are retained on their carriers by clamping alone. In this way local increased stresses, notch effects, and the like are avoided, and both rings 15, 16 can be exchanged without any difficulty if necessary. All that is required to release the inner ring 15 is a loosening of the central screw 14, while disassembly of the outer ring 16 is effected by separating the separator flange 2 from the central flange upon loosening of screws 20.

A lifting ring 17, representing the movable separator member, engages in the space formed between the inner ring 15 and the outer ring 16 which are the stationary members of the apparatus. All three rings 15, 16, 17 preferably are made of hard metal.

The lifting ring 17 is bent at an angle and fixed to a movable guide body 22 by means of a plurality of screws 21, the movable guide body being guided by cylindrical sliding surfaces 23 on the fixed central guide body 9 so that the movable guide body can reciprocate axially in the direction of the central axis 24 of the apparatus.

At the side of the separator remote from the grinding chamber 1 a bearing block 25 formed with a cylindrical sliding surface 26 is mounted on the covering flange 6. With the aid of two ball bearings 27 the bearing block 25 supports an eccentric shaft 28 adapted to be driven in rotation by a geared engine or the like (not shown). One end of a connecting rod 30 is supported on an eccentric portion of the eccentric shaft 28 by way of a ball bearing 29, while the other end comprises a journal bearing bushing 31 which is engaged by an adjustment cam 32 inserted for rotary adjustment in a fork of an intermediate piece 33. This detail is shown again separately in FIG. 3 and in side elevation also in FIG. 3*a*. The adjustment cam 32 includes a front plate 34 with numerous ports 35 for a small screw 36 which holds the adjustment cam 32 in the desired position on the intermediate piece 33. Fine adjustment, for instance in steps of 0.1 mm of the effective length of the intermediate piece 33 can be effected by rotation of the adjustment cam 32.

The intermediate piece 33 is guided in the cylindrical sliding surface 26 of the bearing block 25 and comprises a transverse portion 37 to which a plurality of webs 39 formed at the movable guide body 23 are releasably fixed by means of screws 38. These webs 39 pass through breakthrough openings 40 in the central flange 5 and connect the cam drive means 27 to 32 described above with the lifting ring 17 which is screw-connected with the guide body 22.

At its side facing the grinding chamber 1 the lifting ring 17 comprises outer and inner conical surfaces which define annular gaps 41 with the outer ring 16 and the inner ring 15. Both gaps 41, 42 widen gradually from their beginning which faces the grinding chamber 1. The depth by which the lifting ring 17 immerses in the space between the inner and outer rings 15 and 16 can be varied by rotating the adjustment cam 32, whereby the nominal width of the gaps 41, 42 is adjustable from outside. The stroke of the lifting ring 17 determined by the eccentricity 67 of the eccentric shaft 28 remains uninfluenced by this adjustment of it immersion depth.

The gaps 41, 42 provide communication for the ground material between the grinding chamber 1 and two cavities 43, 44 defined within he separator. Both cavities 43, 44 are interconnected by bores 45 and connected with an inner cavity 47 in the central holding piece 7 by bores 46. Discharge pipe 8 leads to the outside from said inner cavity.

Apart from the seals 11 at the central flange 5, O-ring seals 48, 49 made of elastomeric material such as polytetrafluoroethylene resistant to solvents serve to seal the cavities 43, 44, and 47 which contain ground material during operation of the apparatus. The guide body 22 which is movable together with the lifting ring 17 and has outer and inner cylindrical faces is sealed at its outside, with respect to the guiding central flanges, by O-ring 48 and at it inside, with respect to the stationary guide body 9, by O-ring 49. Each of the O-rings 48 and 49 is received in an annular groove 51 and 52, respectively, in the guide bodies 22 and 9, respectively. Together with lifting ring 17, being the movable separator member, guide body 22 has but a small length of stroke 50 to travel in the order of 1 mm. Therefore, the cross sectional configuration of grooves 51, 52 is as shown on an enlarged scale in FIGS. 9 and 9*a*. The width 52 of each groove 51 and 52 is greater than the space required by the respective O-ring 48 or 49 when slightly compressed. Upon relative movement in the direction of arrows 54 harmful sliding, therefore, can largely be replaced by the roll-off movement illustrated in FIGS. 9 and 9*a*. This affords considerable protection to conserve the expensive O-rings 48 and 49.

Figure 2:
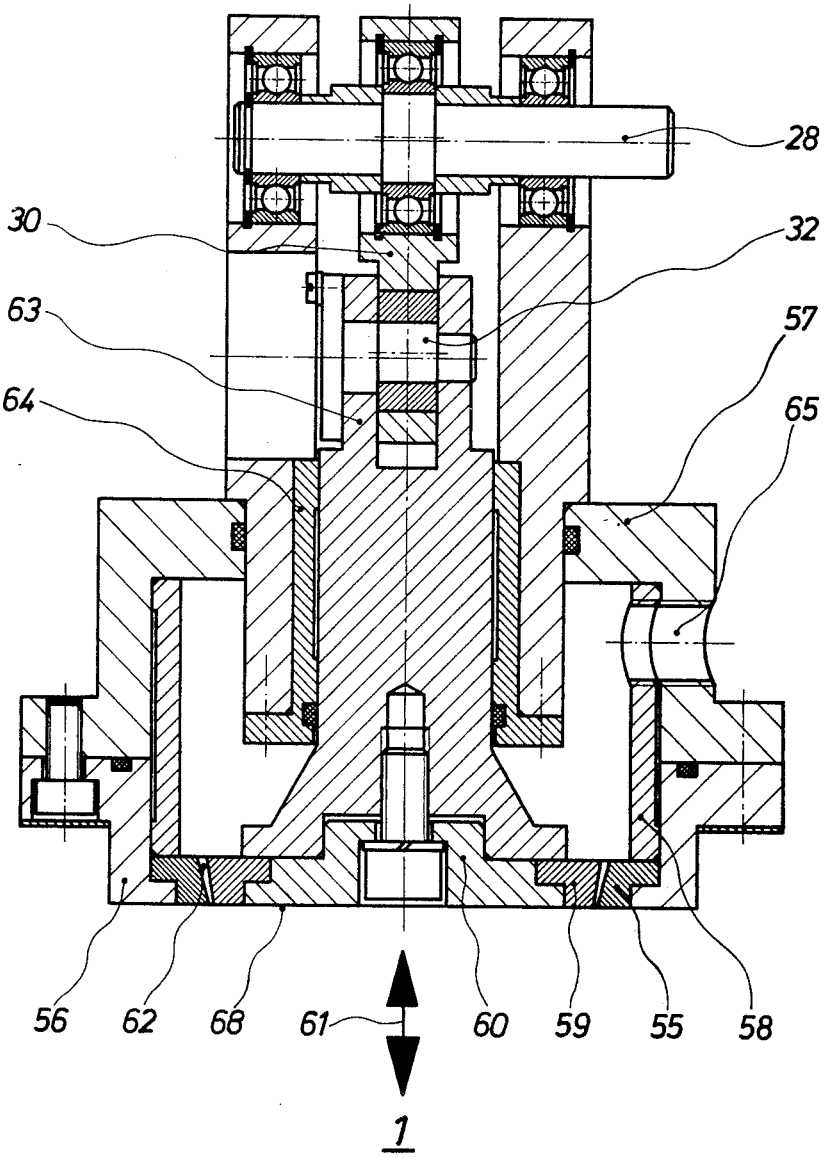
FIG. 2 is an axial section of a second embodiment of a separator.

Also the separator shown in FIG. 2 is rotationally symmetrical in its essential parts. The only stationary separator member is a conical outer ring 55 of hard metal which is clamped by means of two flanges 56, 57 and a sleeve 58. The movable separator member provided with this apparatus is a conical lifting ring 59 which is clamped on a carrier disc 60 in a manner similar to the embodiment shown in FIG. 1. Here a single annular gap 62 is formed between the rings 55 and 59. The surfaces of the two rings 55 and 59 defining this gap are inclined in the same direction but at different degrees with respect to the direction of movement 61 of the lifting ring 59 so that the gap 62 widens gradually from its beginning which faces the grinding chamber 1.

In this case, too, a centrally guided intermediate piece 63 is connected with a connecting rod 30 by means of an adjustment cam 32, the connecting rod being adapted to be driven from an eccentric shaft 28. In this respect reference may be made to the description of FIG. 1. With this structure, too, the nominal width of the gap 62 thus is variable by changing the effective length of the intermediate piece 63 between the eccentric shaft 28 and the lifting ring 59.

According to FIG. 2 a bushing 64 serves to guide the intermediate piece 63. A bore 65 forms the outlet for ground material.

In the case of the separator according to FIG. 1 only the lifting ring 17 with its narrow surface 66 (FIGS. 8 and 8*a*) facing the grinding chamber 1 carries out pounding movement toward the grinding chamber 1 when the eccentric drive 27 to 32 is switched on. With the structure according to FIG. 2, on the other hand, rotation of the eccentric shaft 28 causes reciprocating movement not only of the lifting ring 59 but also of the carrier disc 60 with its full surface 68 facing the grinding chamber 1. Therefore many more adjacent grinding bodies in the grinding chamber 1 are subjected to impact in this case than with the embodiment shown in FIG. 1. Instead of the eccentric drive both structures may be furnished with a mechanical or electrical vibrator or the like or with a drive means of specific kinematics to effect the desired control of the gap width.

FIGS. 4 to 7 and 4*a* to 7*a* are diagrammatic presentations, on an enlarged scale, of some examples of configuration of the separator members and the gaps they define. In all of these figures the grinding chamber side is to be imagined at the bottom and the outside of the separator at the top. FIGS. 4 to 7 show a possible starting position each of the movable separator member, at which position the gap (FIGS. 4 to 6) or each of the gaps (FIGS. 7 and 8) has its nominal width 70. At the right side the approximate end position at the end of the pounding or impact movement of the movable separator member is shown.

The surfaces defining the gap and thus also the gaps themselves may extend along straight or curved lines in all cases. Preferably they are of annular design. For this reason central lines 71 are indicated in several of the figures. As may be recognized from the drawing, the nominal width 70 of the gap may be varied in each instance by a change of the starting position of the movable separator member.

Furthermore, in all cases the impact movement of the movable separator member in its direction of movement 72 reduces the nominal width 70 to a minimum value 73 which may be adjusted down to zero in the manner described.

Figure 5:
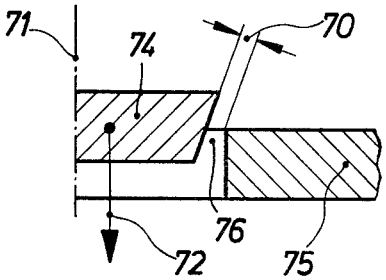
Figure 5A:
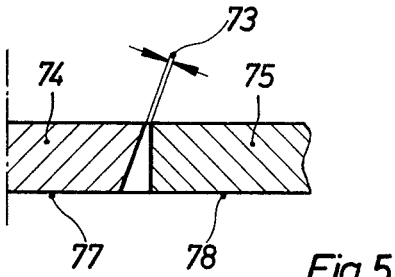

With the exception of FIGS. 5 and 5*a*, all the figures show the gap to have the nominal width 70 at its beginning facing the grinding chamber and to widen uniformly toward the end remote from the grinding chamber. It would also be possible to provide for non-uniform widening of the gap.

Figure 4:
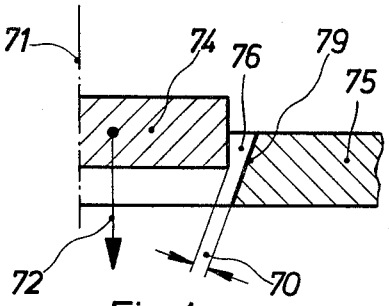
Figure 4A:
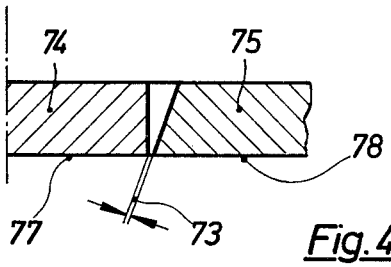

In the case of FIGS. 4 and 4*a* as well as 5 and 5*a* the surface of the one separator member defining the gap extends parallel to the direction of movement 72 of the movable separator member, and the surface of the other separator member defining the gap at the other side is inclined with respect to direction 72.

Figure 6:
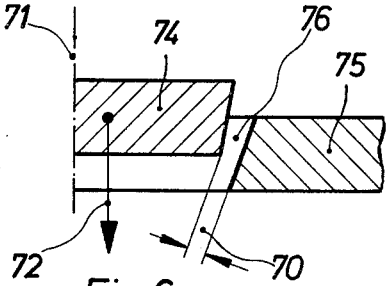
Figure 6A:
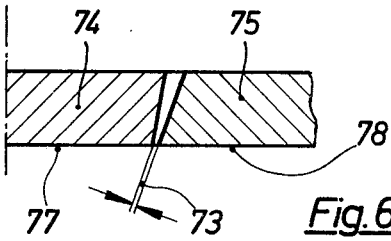

According to FIGS. 6 and 6*a* both surfaces of the separator member defining the gap 76 are inclined in the same direction but at different angles with respect to the direction of movement or impact 72 so that the gap 76 has it nominal width 70 at the grinding chamber side and widens gradually from that side.

Figure 7:
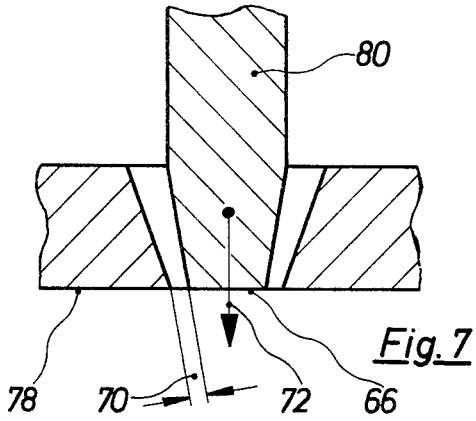
Figure 7A:
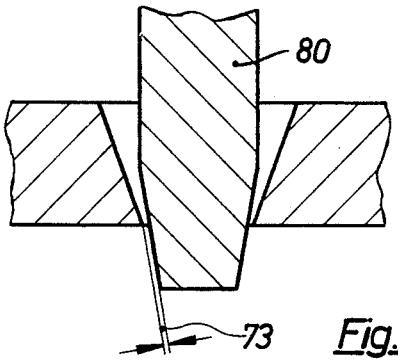

With the embodiments shown in FIGS. 4 and 4*a*, 5 and 5*a*, and 6 and 6*a* the surfaces 77, 78 facing the grinding chamber are almost flush at the end of the impact movement with the movable separator member 74 in end position. If the gap width at this end position is reduced to the minimum value of zero, the contacting edge of the moving separator member 74 may have a chafing effect on the surface 79 of the stationary separator member as they meet at an unfavorable angle. In this respect, for example, the design as illustrated in FIGS. 7 and 7*a* is more advantageous. Here the surfaces 66, 78 of the separator members facing the grinding chamber are approximately aligned when the movable separator member 80 is in its starting position. In the end position according to FIG. 7*a*, however, the separator member 80 having been moved protrudes beyond the surfaces 78 at the grinding chamber side. If the minimum value 73 of the gap width is adjusted to zero with this arrangement, a squeezing effect only is obtained instead of a sharp cutting effect so that the wear is reduced.

Figure 8:
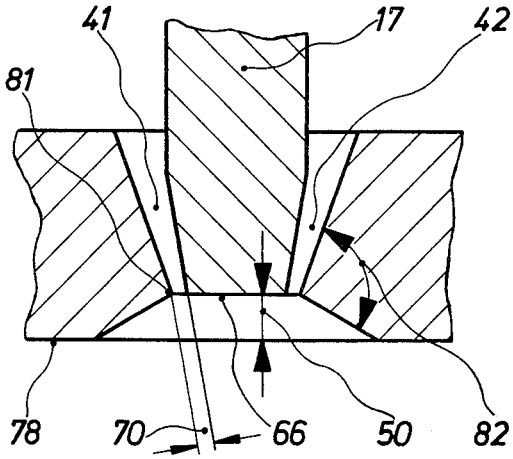
Figure 8A:
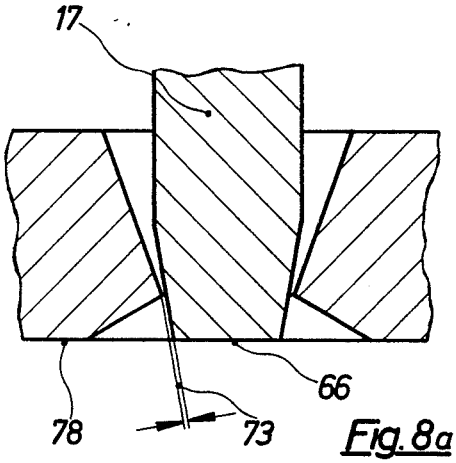

FIGS. 7 and 8*a* show the preferred design which corresponds to FIG. 1 on an enlarged scale. Here the surface 66 of the lifting ring 17 facing the grinding chamber is offset backwards, for instance by the extent 50, with respect to the adjacent surfaces 78 when the lifting ring is in its starting position, the extent 50 corresponding approximately to the stroke of the lifting ring 17. In FIG. 8*a* the lifting ring 17 is shown in its end position in which surface 66 is approximately flush with surfaces 78. This offsetting in the starting position has the advantage that, instead of the sharp corners of FIG. 7, obtuse angles 82 are formed at the edges 81 of the stationary separator members (inner and outer rings 15, 16). This is an important aspect because of the hard metal normally required for the separator members.

What we claim is:

1. A separator for separating grinding bodies and ground material in an agitator mill, comprising separator members which border on a grinding chamber and define at least one gap between them of a nominal width smaller than the nominal size of the grinding bodies in the grinding chamber, at least one separator member being arranged to be stationary and at least one separator member being designed to be movable and connected with a drive means adapted to impart oscillating motions to the movable separator member in the direction of flow and contrary to the direction of flow of the ground material passing through the gap, comprising at least one of the separator members (15, 16, 17; 55, 59; 74, 75; 80) being so tapered at its side facing the gap (41, 42; 62; 76) that the gap narrows from its nominal width (70) to a minimum value (73) whenever the movable separator member (17; 59; 74; 80) moves against the flow of the ground material.

2. A separator as claimed in claim 1 further including the oscillating frequency of the movable separator member (17; 59; 74; 80) being from 1 to 40, preferably from 20 to 30 cycles per second.

3. A separator as claimed in claim 1 or 2, further including the shape of the tapering separator member (15, 16; 55, 59; 74, 75; 80) and the drive means being correlated that in its reciprocating movements the movable separator member (17; 59; 74; 80) is approximately in the position at which the effective gap width corresponds to the nominal width (70) for a longer period of time than in the position at which the effective gap width is reduced to a minimum value (73).

4. A separator as claimed in claim 1 further including that upon movement of the movable separator member (17; 59; 74; 80) out of its starting position the effective gap width is reducible temporarily from nominal width (70) to a minimum value (73) of zero.

5. A separator as claimed in claim 1, in which the surfaces of two separator members defining a gap (41, 42; 76) are so inclined with respect to each other that with the movable separator member (17; 59; 74; 80) in its starting position, the gap (41, 42; 76) has a nominal width (70) at its beginning facing the grinding chamber (1) and widens from that position in the direction toward its end which is remote from the grinding chamber (1).

6. A separator as claimed in claim 1, in which the surface of the one separator member (74, 75) defining a gap is designed to be parallel to the direction of movement (72) of the movable separator member (74) and the surface of the other separator member (75, 74) defining the gap is inclined with respect to the direction of movement (72).

7. A separator as claimed in claim 1, in which the surfaces of two separator members defining a gap (76) are inclined in the same direction but at different degrees with respect to the direction of movement (72) of the movable separator member.

8. A separator as claimed in claim 1 comprising intermediate members between the drive means and the movable separator member, in which the effective length of the intermediate members (30, 33, 37, 39; 30, 63) is variable for adjustment of the nominal width (70) of the gap (41, 42; 76).

9. A separator as claimed in claim 8, in which the surfaces (66, 78) of the separator members facing the grinding chamber (1) are at least approximately aligned when the movable separator member (17; 59; 80) is in its starting position, and in that at the end of its movement toward the grinding chamber (1) the movable separator member (17; 59; 80) protrudes beyond the adjacent surfaces (78) of the fixed separator members (16; 55; 75) facing the grinding chamber (1).

10. A separator as claimed in claim 7, in which the movable separator member is a conical lifting ring (59) whose conical circumferential surface has its smallest diameter at its beginning facing the grinding chamber (1), and the stationary separator member is an outer ring (55) whose internal annular surface is more strongly conically inclined than the conical circumferential surface of the lifting ring (59) so that the gap (62) between the lifting ring (59) and the outer ring (55) widens gradually from its beginning facing the grinding chamber (1).

11. A separator as claimed in claim 7, in which the movable separator member is a lifting ring (17) which comprises outer as well as inner conical annular surfaces at its end facing the grinding chamber (1) and forms two annular gaps (41, 42) together with a stationary outer ring (16) and a stationary inner ring (15), the gaps widening gradually from their beginning facing the grinding chamber (1).

12. A separator as claimed in claim 11, in which the inner ring (15) and the outer ring (16) enclosing parts of the lifting ring (17) comprise an obtuse angle (82) at the edges (81) between their conical outer and inner surfaces, respectively, and the adjacent surface facing the grinding chamber (1) at the beginning of the gaps (41, 42).

13. A separator as claimed in claim 11 or 12, in which at least one of the rings (15, 16) is of hard metal and are held on carrier members (13, 2) only by clamping members (18, 19).

14. A separator as claimed in claim 11, or 12, in which the lifting ring (17) is fixed to a guide body (22) which is movable by an eccentric drive means (27 to 32).

15. A separator as claimed in claim 14, in which the inner ring (15) is fixed by means of a carrier disc (13) and a clamping disc (18) to a central stationary guide body (9) for the movable guide body (22) of the lifting ring (17).

16. A separator as claimed in claim 15, in which the stationary guide body (9) is fixed by means of a flange (5) to the cover or wall of the grinding vessel in a manner releasable from the grinding chamber side.

17. A separator as claimed in claim 16, in which the flange (5) comprises break-through openings (40) through which webs (39) are passed to connect the movable guide body (22) with the eccentric drive means (27 to 32).

18. A separator as claimed in claim 14, in which the eccentric drive means (27 to 32) comprises a connecting rod (30) which is rotatably supported on an eccentric shaft (28) and connected by an adjustment cam (32) with a driven intermediate piece (33) connected with the guide body (22) of the lifting ring (17) such that the depth of immersion of the lifting ring (17) into the space between the inner ring (15) and the outer ring (16) is adjustable.

19. A separator as claimed in claim 14, further comprising that in the guide body (5, 22) O-rings (48, 49) are disposed in grooves (51, 52) which are a little wider than the compressed O-rings (48, 49) and which permit the O-rings to roll off along the cylindrical surface during movement of the movable body (22).

20. A method of operating an apparatus as claimed in claim 1, in which the drive for the movable separator members (17; 59; 74; 80) is switched on when the pressure in the grinding chamber (1) surpasses an adjustable normal level.

* * * * *